US011223902B2

(12) United States Patent
Zhao et al.

(10) Patent No.: US 11,223,902 B2
(45) Date of Patent: Jan. 11, 2022

(54) SURROUND-SCREEN SPEAKER ARRAY AND THE FORMATION METHOD OF VIRTUAL SOUND SOURCE

(71) Applicant: SOUNDKING ELECTRONICS & SOUND CO., LTD., Ningbo (CN)

(72) Inventors: Qian Zhao, Zhejiang (CN); Jianguo Zheng, Zhejiang (CN)

(73) Assignee: SOUNDKING ELECTRONICS & SOUND CO., LTD., Ningbo (CN)

( * ) Notice: Subject to any disclaimer, the term of this patent is extended or adjusted under 35 U.S.C. 154(b) by 0 days.

(21) Appl. No.: 16/758,854

(22) PCT Filed: Sep. 30, 2018

(86) PCT No.: PCT/CN2018/109215

§ 371 (c)(1),
(2) Date: Apr. 24, 2020

(87) PCT Pub. No.: WO2020/047930

PCT Pub. Date: Mar. 12, 2020

(65) Prior Publication Data

US 2020/0351589 A1 Nov. 5, 2020

(30) Foreign Application Priority Data

Sep. 4, 2018 (CN) ..... 201811028396.5

(51) Int. Cl.
*H04R 5/02* (2006.01)
*H04R 1/26* (2006.01)
*H04R 1/40* (2006.01)

(52) U.S. Cl.
CPC ..... *H04R 5/02* (2013.01); *H04R 1/26* (2013.01); *H04R 1/403* (2013.01); *H04R 2499/15* (2013.01)

(58) Field of Classification Search
None
See application file for complete search history.

(56) References Cited

U.S. PATENT DOCUMENTS

2013/0163952 A1* 6/2013 Ni ..... H04N 21/4325 386/230

* cited by examiner

*Primary Examiner* — Kenny H Truong
(74) *Attorney, Agent, or Firm* — Chun-Ming Shih; Lanway IPR Services

(57) ABSTRACT

The present disclosure is related to a surround-screen speaker array and a formation method of sound sources. The surround-screen speaker array includes a plurality of speaker subarrays that are disposed around a sound-proof screen tightly and uniformly. The speaker subarrays disposed around the sound-proof screen successfully provides a solution to reinforcement sound of a main sound channel for a movie screen that adopts a sound-proof material. Therefore, it is possible that the sound-proof screen can be used as the movie screen.

3 Claims, 4 Drawing Sheets

SURROUND-SCREEN SPEAKER ARRAY AND THE FORMATION METHOD OF VIRTUAL SOUND SOURCE

FIELD OF THE DISCLOSURE

The present disclosure is related to a surround-screen speaker array, and more particularly to the surround-screen speaker array that is applicable to a large LED screen, and the formation method of virtual sound source.

BACKGROUND OF THE DISCLOSURE

Recently, with the high development of technologies for manufacturing large LED screens, the resolutions ratio of the large LED screen can successfully achieve the professional level of high-resolution digital projectors. The size of screen of the LED screen may not be restricted. However, the market still urgently needs a digital cinema sound reproduction system that can operate with the large LED screen to display video.

The material of screen used in the conventional cinema is generally a kind of sound-permeable material. Both a horn-type main speaker system and an ultra-low frequency speaker generally work behind the sound-permeable screen. However, when the movie screen is a non-sound-transmitting material such as an LED screen, the traditional main channel sound reinforcement system cannot work. The speaker array can solve the problem of sound reinforcement of the main channel, and it also has many features that are difficult to achieve with traditional main channel sound reinforcement systems. The speaker array can solve the problem of sound reproduction of the main channel, and also has many characteristics of the traditional sound reproduction system of the main channel, which are difficult to achieve with the traditional sound reproduction system. The traditional movie reproduction system has sweet point. Only when the audience sits at the sweet point, the sound source position and intensity are correct, and the sense of space is the best. Many seats in the cinema are not the sweet points. The position and intensity of the sound source heard by the audience are biased. The invention forms a virtual sound source through a specific algorithms, which can eliminate the sweet point in the cinema, and the direction and position of the sound source heard by the audience at any position in the cinema is always correct.

SUMMARY OF THE DISCLOSURE

The surround-screen speaker array and the formation method of virtual sound source are provided for solving the technical problems such as (1) sound reinforcement in the main channel when the movie screen is not sound-transmitting material. (2) The traditional movie sound reproduction system has the sweet point. The surround-screen speaker array solves the problem of the sweet point, and the sound source position is always correct at any position in the cinema.

For solving the above-discussed technical problems, a solution of the present disclosure is described as follows.

The solution is related to a surround-screen speaker array. The surround-screen speaker array is characterized in including a plurality of speaker subarrays that are disposed around a sound-proof screen.

Every speaker subarray is composed of one or more layers of various arrangements of transducers.

Further, in the speaker subarray, a first transducer group uses one transducer with diameter 'd', a second transducer group with diameter 'd/2' for each, and a third transducer group with diameter 'd/5' for each.

If the speaker subarray is composed of single layer of transducer, the speaker subarray adopts a full-frequency audio signal processing method, in which the first transducer group is in charge of processing the full-frequency audio signals.

If the speaker subarray is composed of two layers of transducers, the speaker subarray adopts a frequency-division audio signal processing method, in which the first transducer group at lower layer is in charge of processing the low-frequency audio signals, and the second transducer group at upper layer is in charge of processing the high-frequency audio signals. A division point '$f_1$' between the low frequency and the high frequency should satisfy the following condition:

$$f_1 < \frac{v}{2d}$$

wherein, 'v' denotes sound speed.

Alternatively,

If the speaker subarray is composed of three layers of transducers in various arrangements, the speaker subarray adopts a three-divided frequency audio signal processing method, in which every layer of audio signals corresponds to different frequency band. The first transducer group at lower layer is in charge of processing low-frequency audio signals. The second transducer group at middle layer is in charge of processing middle-frequency audio signals. The third transducer group (23) at upper layer is in charge of processing high-frequency audio signals.

A division point '$f_2$' between the low frequency and the middle frequency should satisfy the following condition:

$$f_2 < \frac{v}{2d}$$

A division point '$f_3$' between the middle frequency and the high frequency should satisfy the following condition:

$$f_3 < \frac{v}{d}$$

In the same group, the phases of transducers are consistent, and their sensitivities, sizes and rated powers are configured to be the same.

In one aspect of the disclosure, the transducers can be divided into three layers including a first transducer group with one transducer, a second transducer group with four transducers, and a third transducer group with nine transducer that are arranged in a cross shape.

Further, three centers respective to the three layers of transducer groups are at the same position corresponding to the center of the first transducer group.

It should be noted that the sound-proof screen is an LED screen, an OLED screen or any self-luminous screen.

The formation method of the virtual sound source can be adapted to a sound-proof screen with a plurality of speaker subarrays that are disposed around the screen. In the method, the sound signals of the speaker subarrays (2) are changed by an algorithm. It is equivalent to the sound field generated by the original sound source at this position to form a virtual sound source, which reproduces the time and space characteristics of the original sound field.

Further, the virtual sound source is represented by 'S', and signals of the virtual sound source are transformed to '$S_1(w)$' through a Fourier Transform method. The signals are processed by a filtering process to obtain signals in three frequency bands in which '$S_1(w)$' denotes a low frequency band, '$S_2(w)$' denotes a middle frequency band, and '$S_3(w)$' denotes a high frequency band. In the equation, the driving signals of a first transducer group are represented as '$D_1(a)$', the driving signals of a second transducer group are represented as '$D_2(a)$', and the driving signals of a third transducer group are represented as '$D_3(a)$.' The symbol 'a' denotes a position of the transducer. Further, '$L_1$' denotes a distance from the first transducer group to the second transducer group, and '$L_2$' denotes a distance from the first transducer group to the third transducer group. Still further, '$y_1$' denotes a normal distance between the virtual sound source behind the speaker array and the first transducer group, '$y_2$' denotes another normal distance between an audience in front of the speaker array and the first transducer group, '$r_1$' denotes a straight-line distance between the virtual sound source and the transducer, T denotes imaginary number, 'w' denotes angular frequency, 'e' denotes natural logarithm; and 'v' denotes sound speed. Based on the above description, the equation for the signals in three frequency bands as calculated can be indicated as:

$$D_1(a) = S_1(w)\sqrt{\frac{jwy_2}{2\pi v(y_1+y_2)}}\cdot\frac{y_1 e^{-j\frac{wr_1}{v}}}{r_1^{3/2}};$$

$$D_2(a) = S_2(w)\sqrt{\frac{jw(y_2-L_1)}{2\pi v(y_1+y_2)}}\cdot\frac{(y_1+L_1)e^{-j\frac{wr_1}{v}}}{r_1^{3/2}};$$

$$D_3(a) = S_3(w)\sqrt{\frac{jw(y_2-L_2)}{2\pi v(y_1+y_2)}}\cdot\frac{(y_1+L_2)e^{-j\frac{wr_1}{v}}}{r_1^{3/2}}.$$

In one further aspect of the disclosure, not only the speaker subarrays can be used to form the virtual sound source behind the screen, but also a front focused sound source can be formed so as to allow the virtual sound source with various depths.

According to one embodiment of the present disclosure, in the equations shown below, '$y_3$' denotes a normal distance between the speaker array and the virtual sound source in front of the speaker array, '$y_4$' denotes another normal distance between the speaker array and the audience in front of the speaker array, '$r_2$' denotes a straight-line distance between the virtual sound source and the transducer, '$Q_1(a)$' denotes driving signals of the first transducer group, '$Q_2(a)$' denotes driving signals of the second transducer group, and '$Q_3(a)$' denotes driving signals of the third transducer group.

Further, the symbol 'a' denotes the position of the transducer, '$L_1$' denotes a distance from the first transducer group to the second transducer group, '$L_2$' denotes a distance from the first transducer group to the third transducer group.

Further, 'v' denotes the sound speed, T denotes imaginary number, 'w' denotes angular frequency, and 'e' denotes natural logarithm; wherein, $y_4>y_3$ and conjugate functions of '$Q_1$*(a)', '$Q_2$*(a)' and '$Q_3$*(a)' respectively are:

$$Q_1^*(a) = S_1(w)\sqrt{\frac{jwy_4}{2\pi v(y_3+y_4)}}\cdot\frac{y_3 e^{-j\frac{wr_1}{v}}}{r_2^{3/2}};$$

-continued $$Q_2^*(a) = S_2(w)\sqrt{\frac{jw(y_4-L_1)}{2\pi v(y_3+y_4-2L_1)}}\cdot\frac{(y_3-L_1)e^{-j\frac{wr_1}{v}}}{r_2^{3/2}};$$

$$Q_3^*(a) = S_3(w)\sqrt{\frac{jw(y_4-L_2)}{2\pi v(y_3+y_4-2L_2)}}\cdot\frac{(y_3-L_2)e^{-j\frac{wr_1}{v}}}{r_2^{3/2}}$$

wherein, '$Q_1$*(a)' represents the conjugate of '$Q_1(a)$'.

Still further, not only the speaker array embodies a single virtual sound source, but also a reflected sound of the virtual sound source at a same time when another virtual sound source having the same acoustic signals with the virtual sound source at different positions is formed. An amplitude of the acoustic signals is attenuated by β times and relationship between driving signals J(a) of the transducer and the virtual sound source is expressed by:

$$J_1(a) = \frac{1}{\beta(w)}S_1(w)\sqrt{\frac{jwy_2}{2\pi v(y_1+y_2)}}\cdot\frac{y_1 e^{-j\frac{wr_1}{v}}}{r_1^{3/2}};$$

$$J_2(a) = \frac{1}{\beta(w)}S_2(w)\sqrt{\frac{jw(y_2-L_1)}{2\pi v(y_1+y_2)}}\cdot\frac{(y_1+L_1)e^{-j\frac{wr_1}{v}}}{r_1^{3/2}};$$

$$J_3(a) = \frac{1}{\beta(w)}S_3(w)\sqrt{\frac{jw(y_2-L_2)}{2\pi v(y_1+y_2)}}\cdot\frac{(y_1+L_2)e^{-j\frac{wr_1}{v}}}{r_1^{3/2}}.$$

β(w) is a function relating to frequencies of reflected sounds and reflection coefficients. The method successfully increases the audience's sense of space and distance through the reflected sounds being formed at different positions. Further, the audience can also feel a sense of reverberation from the virtual sound sources through the attenuated reflected sounds at different positions that form the changeable reverberations.

The surround-screen speaker array and the formation method for virtual sound source provide the following advantages.

(1) The surround-screen speaker array adopts a solution that utilizes a plurality of speaker subarrays tightly and uniformly disposed around the sound-proof screen. It solves the problem of sound reinforcement of the main channel of the movie screen as a non-transparent material, and it becomes feasible to use a non-transparent material for the movie screen.

(2) The surround-screen speaker array can suitably be adapted to the LED screen. This approach facilitates installation of the equipment that can be used outdoors without limitation of location.

(3) The surround screen speaker array realizes virtual sound sources at different depths and positions on the screen. No matter where the audience is, the audiovisual position is always correct. It does not change with the change of audience position, nor is it restricted by sweet point. The position of the virtual sound source is not limited to the screen area, but is adjusted in time according to the movie content. When the LED screen is naked-eye 3D, it can achieve the effect of audio-visual integration and increase audience immersion.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
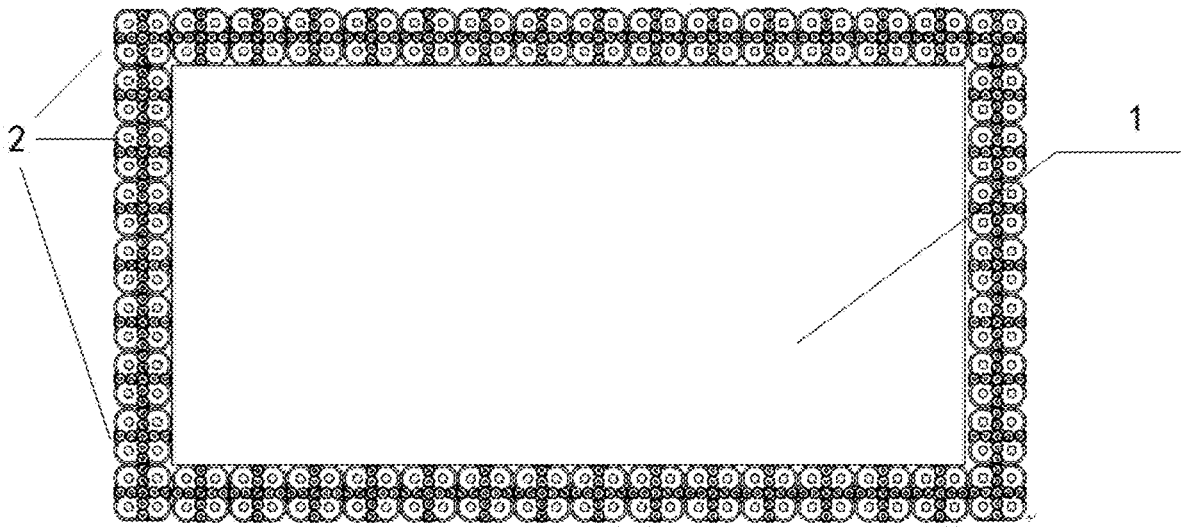
FIG. 1 is a schematic diagram depicting installation of a surround-screen speaker array according to one embodiment of the disclosure.
Figure 2:
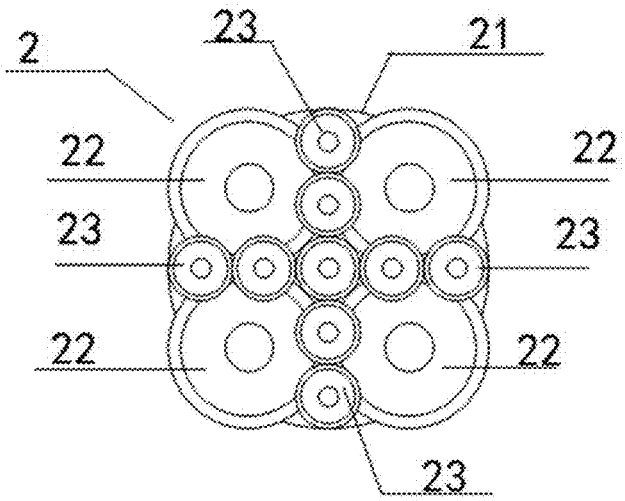
FIG. 2 is a schematic diagram depicting an assembly of speaker subarrays in one embodiment of the disclosure.
Figure 3:
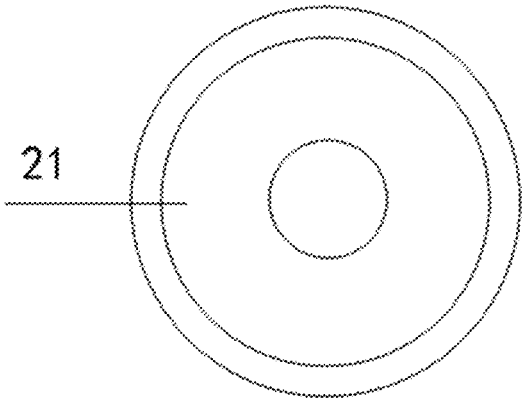
FIG. 3 is a schematic diagram depicting a first transducer group of the speaker subarray according to one embodiment of the disclosure.
Figure 4:
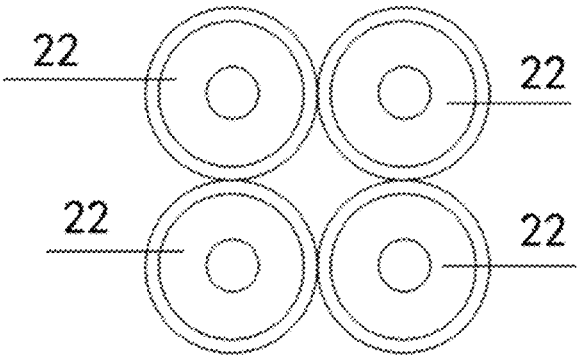
FIG. 4 is a schematic diagram depicting a second transducer group of the speaker subarray according to one further embodiment of the disclosure.
Figure 5:
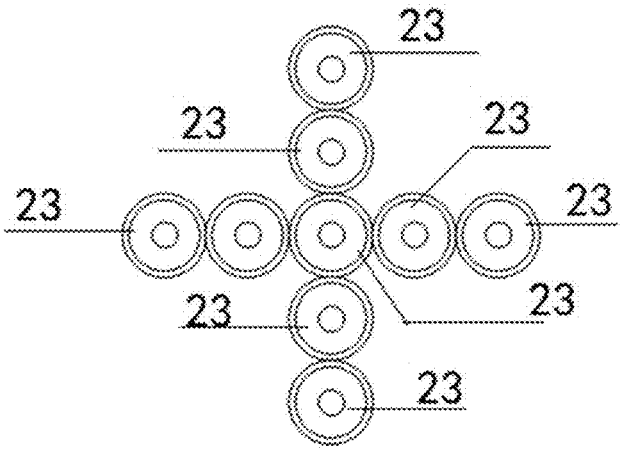
FIG. 5 is a schematic diagram depicting a third transducer group of the speaker subarray according to another embodiment of the disclosure.
Figure 6:
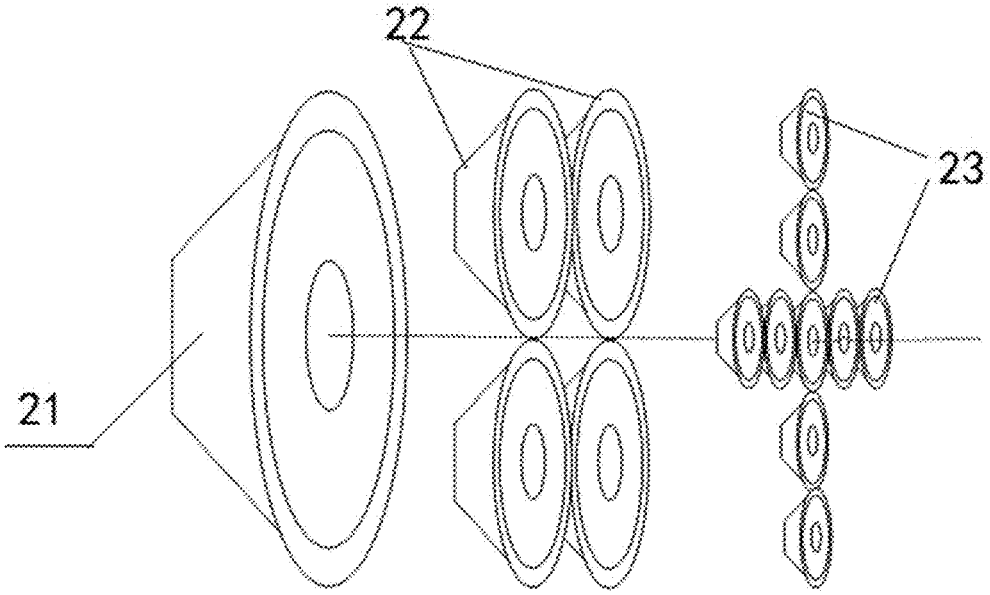
FIG. 6 is a schematic diagram showing a sectional view of a combination of multiple layers of transducer groups of the speaker subarray in on embodiment of the disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

References are made to FIG. 1 to FIG. 7, which show schematic diagrams depicting a surround-screen speaker array and a method for rendering virtual sound sources therefor in the embodiments of the present disclosure.

A surround-screen speaker array includes a plurality of speaker subarrays that are disposed around a sound-proofing screen tightly and uniformly. The sound-proof screen can be an LED screen 1 or an OLED screen.

Each of the speaker subarrays 2 can be composed of the transducers in various arrangements. For example, the speaker subarray 2 is composed of three layers of transducers in different arrangements, and therefore adopts a method for processing three-divided frequency audio signals. Each layer of transducers corresponds to the audio signals in one of the different frequency bands. A first transducer group 21 at the lower layer is in charge of processing low-frequency audio signals. A second transducer group 22 at the middle layer is in charge of processing middle-frequency audio signals. A third transducer group 23 at the upper layer is in charge of processing high-frequency signals. In one aspect of the disclosure, the first transducer group 21 adopts one transducer, the second transducer group 22 adopts four transducers and the third transducer group 23 adopts nine transducers that are arranged in a cross shape.

The operational principle of the method for controlling the surround-screen speaker array of the present disclosure is described as follows.

In the speaker subarray, a first transducer group uses one transducer with diameter 'd', a second transducer group with diameter 'd/2' for each, and a third transducer group with diameter 'd/5' for each.

If the speaker subarray is composed of single layer of transducer, the speaker subarray adopts a full-frequency audio signal processing method, in which the first transducer group is in charge of processing the full-frequency audio signals.

If the speaker subarray is composed of two layers of transducers, the speaker subarray adopts a frequency-division audio signal processing method, in which the first transducer group at lower layer is in charge of processing the low-frequency audio signals, and the second transducer group at upper layer is in charge of processing the high-frequency audio signals. A division point '$f_1$' between the low frequency and the high frequency should satisfy the following condition:

$$f_1 < \frac{v}{2d}$$

wherein, 'v' denotes sound speed.

Alternatively,

If the speaker subarray is composed of three layers of transducers in various arrangements, the speaker subarray adopts a three-divided frequency audio signal processing method, in which every layer of audio signals corresponds to different frequency band. The first transducer group at lower layer is in charge of processing low-frequency audio signals. The second transducer group at middle layer is in charge of processing middle-frequency audio signals. The third transducer group (23) at upper layer is in charge of processing high-frequency audio signals.

A division point '$f_2$' between the low frequency and the middle frequency should satisfy the following condition:

$$f_2 < \frac{v}{2d}$$

A division point '$f_3$' between the middle frequency and the high frequency should satisfy the following condition:

$$f_3 < \frac{v}{d}$$

In the same group, the phases of transducers are consistent, and their sensitivities, sizes and rated powers are configured to be the same.

In a method for controlling a surround-screen speaker array to be operated with a screen picture, the acoustic signals of the speaker subarrays are changed for allowing the acoustic signals to be equivalent to a sound field formed by an original sound source at the position of the speaker subarray, and a virtual sound source is therefore formed to reproduce properties of time and space of an original sound field. The surround-screen speaker array implements the virtual sound sources at different depths and positions over a direction of a sound-proof screen. Alternatively, the virtual sound sources may also be rendered at the different depths and positions outside the sound-proof screen.

The virtual sound source is represented by 'S', and signals of the virtual sound source are transformed to 'S(w)' through a Fourier Transform method. The signals are processed by a filtering process to obtain signals in three frequency bands in which '$S_1$(w)' denotes a low frequency band, '$S_2$(w)' denotes a middle frequency band, and '$S_3$(w)' denotes a high frequency band. The driving signals of the first transducer group are represented as '$D_1$a', the driving signals of the second transducer group are represented as '$D_2$a' and driving signals of the third transducer group are represented as '$D_3$a.' Further, the symbol 'a' denotes the position of the transducer, '$L_1$' denotes a distance from the first transducer group to the second transducer group, and '$L_2$' denotes a distance from the first transducer group to the third transducer group. Still further, '$y_1$' denotes a normal distance between the virtual sound source behind the speaker array and the first transducer group, '$y_2$' denotes another normal distance between an audience in front of the speaker array and the first transducer group, '$r_1$' denotes a straight-line distance between the virtual sound source and the transducer, T denotes imaginary number, 'w' denotes angular frequency, 'e' denotes natural logarithm; and 'w' denotes sound speed. The signals in three frequency bands as calculated by the equations of:

$$D_1(a) = S_1(w)\sqrt{\frac{jwy_2}{2\pi v(y_1+y_2)}}\cdot\frac{y_1 e^{-j\frac{wr_1}{v}}}{r_1^{3/2}};$$

$$D_2(a) = S_2(w)\sqrt{\frac{j(y_2-L_1)}{2\pi v(y_1+y_2)}}\cdot\frac{(y_1+L_1)e^{-j\frac{wr_1}{v}}}{r_1^{3/2}};$$

$$D_3(a) = S_3(w)\sqrt{\frac{jw(y_2-L_2)}{2\pi v(y_1+y_2)}}\cdot\frac{(y_1+L_2)e^{-j\frac{wr_1}{v}}}{r_1^{3/2}}.$$

Not only the speaker subarrays can be used to form the virtual sound source behind the surround-screen speaker array, but also a front focused sound source can be formed so as to allow the virtual sound source with various depths. One of the specific methods is described as follows. In the equation, '$y_3$' denotes a normal distance between the speaker array and the virtual sound source in front of the speaker array, '$y_4$' denotes another normal distance between the speaker array and the audience in front of the speaker array, '$r_2$' denotes a straight-line distance between the virtual sound source and the transducer. '$Q_1$(a)' denotes driving signals of the first transducer group, '$Q_2(a)$' denotes driving signals of the second transducer group, and '$Q_3(a)$' denotes driving signals of the third transducer group. Further, in the equation, the symbol 'a' denotes the position of the transducer, '$L_1$' denotes a distance from the first transducer group to the second transducer group, and '$L_2$' denotes a distance from the first transducer group to the third transducer group. The above-mentioned normal distance '$y_4$' is larger than the normal distance '$y_3$.' 'v' still denotes the sound speed. The equations below show the conjugate functions of '$Q_1$(a)', '$Q_2$(a)' and '$Q_3$(a)'.

$$Q_1^*(a) = S_1(w)\sqrt{\frac{jwy_4}{2\pi v(y_3+y_4)}}\cdot\frac{y_3 e^{-j\frac{wr_1}{v}}}{r_2^{3/2}};$$

$$Q_2^*(a) = S_2(w)\sqrt{\frac{jw(y_4-L_1)}{2\pi v(y_3+y_4-2L_1)}}\cdot\frac{(y_3-L_1)e^{-j\frac{wr_1}{v}}}{r_2^{3/2}};$$

$$Q_3^*(a) = S_3(w)\sqrt{\frac{jw(y_4-L_2)}{2\pi v(y_3+y_4-2L_2)}}\cdot\frac{(y_3-L_2)e^{-j\frac{wr_1}{v}}}{r_2^{3/2}};$$

wherein, 'Q*(a)' represents the conjugate of 'Q(a)'.

Figure 7:
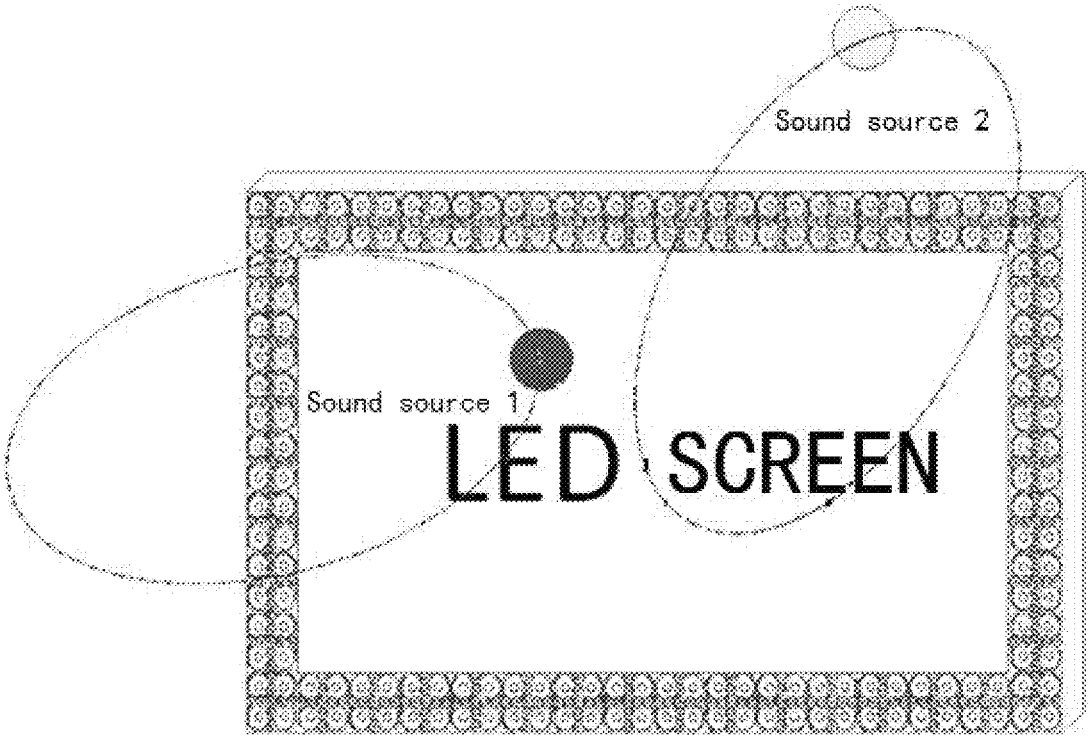
FIG. 7 is a schematic diagram depicting virtual motion sound source for surround screen speaker array according to one embodiment of the disclosure.

The above-mentioned procedure for processing the signals of the virtual sound sources can change positions of the virtual sound sources in real time so as to render the simulated moving sound sources, as shown in FIG. 7. In an exemplary example shown in FIG. 7, a virtual sound source 1 and a virtual sound source 2 move upward, downward, leftward, rightward, forward and backward in real time. The positions of the virtual sound source should be consistent with images of the movie. The method allows the audio and video to be correlated for providing a realistic dual-3D cinematic perception.

By rendering virtual sound source with the same signals of the original virtual sound source at a different position, not only the speaker array implements the single virtual sound source, but also a reflected sound of the virtual sound source can be made. The amplitude of the signals rendered at the different position may be attenuated by β times. Relationship between driving signals J(a) of the transducer and the original virtual sound source is expressed by:

$$J_1(a) = \frac{1}{\beta(w)}S_1(w)\sqrt{\frac{jwy_2}{2\pi v(y_1+y_2)}}\cdot\frac{y_1 e^{-j\frac{wr_1}{v}}}{r_1^{3/2}};$$

$$J_2(a) = \frac{1}{\beta(w)}S_2(w)\sqrt{\frac{jw(y_2-L_1)}{2\pi v(y_1+y_2)}}\cdot\frac{(y_1+L_1)e^{-j\frac{wr_1}{v}}}{r_1^{3/2}};$$

$$J_3(a) = \frac{1}{\beta(w)}S_3(w)\sqrt{\frac{jw(y_2-L_2)}{2\pi v(y_1+y_2)}}\cdot\frac{(y_1+L_2)e^{-j\frac{wr_1}{v}}}{r_1^{3/2}}.$$

β(w) is a function relating to frequencies of reflected sounds and reflection coefficients. The method of the disclosure successfully increases the audience's sense of space and distance through the reflected sounds being formed at different positions. Further, the audience also feels a sense of reverberation from the virtual sound sources through the attenuated reflected sounds at different positions that form the changeable reverberations.

Since the screening environments of many cinemas are not ideal, the reflected sounds rendered from the original virtual sound sources at different positions can neutralize the reflected sounds from the real scene. In other words, the surround-screen speaker array of the disclosure is able to compensate the acoustic environment of the cinema for reaching a best movie-watching experience.

Furthermore, the arrangement of the surround-screen speaker array of the disclosure is not restricted by the conventional concept of sweet point since it allows the audiences to have correct audio-visual positions no matter where they are. The surround-screen speaker array also well combines the audio and the video for increasing sense of presence and immersion for the audiences. At the same time, the method can compensate the poor acoustic environment of the cinema which the original sound reproduction system fails to reach.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A formation method fora virtual sound source adapted to a surround-screen speaker array that includes a plurality of speaker subarrays being disposed around a sound-proof screen, wherein the method comprises:

changing sound signals of the speaker subarrays by an equation for forming the virtual sound source adapted to the speaker array so as to be equivalent to a sound field generated by an original sound source at a position of the speaker subarrays, so that characteristics of time and space of the sound field of the original sound source are able to be reproduced by the virtual sound source;

wherein the virtual sound source is represented by 'S', and signals of the virtual sound source are transformed to 'S(w)' through a Fourier Transform method; the signals are processed by a filtering process to obtain signals in three frequency bands in which '$S_1(w)$' denotes a low frequency band, '$S_2(w)$' denotes a middle frequency band, and '$S_3(w)$' denotes a high frequency band; driving signals of a first transducer group are represented as '$D_1(a)$', driving signals of a second transducer group are represented as '$D_2(a)$', and driving signals of a third transducer group are represented as '$D_3(a)$'; wherein, 'a' denotes the position of the transducer, '$L_1$' denotes a distance from the first transducer group to the second transducer group, '$L_2$' denotes a distance from the first transducer group to the third transducer group, '$y_1$' denotes a normal distance between the virtual sound source behind the speaker array and the first transducer group, '$y_2$' denotes another normal distance between an audience in front of the speaker array and the first transducer group, '$r_1$' denotes a straight-line distance between the virtual sound source and the transducer, 'j' denotes imaginary number, 'w' denotes angular frequency, 'e' denotes natural logarithm; and 'v' denotes sound speed, the signals in three frequency bands as calculated by the equations of:

$$D_1(a) = S_1(w)\sqrt{\frac{jwy_2}{2\pi v(y_1+y_2)}}\cdot\frac{y_1 e^{-j\frac{wr_1}{v}}}{r_1^{3/2}};$$

-continued $$D_2(a) = S_2(w)\sqrt{\frac{jw(y_2-L_1)}{2\pi v(y_1+y_2)}}\cdot\frac{(y_1+L_1)e^{-j\frac{wr_1}{v}}}{r_1^{3/2}};$$

$$D_3(a) = S_3(w)\sqrt{\frac{jw(y_2-L_2)}{2\pi v(y_1+y_2)}}\cdot\frac{(y_1+L_2)e^{-j\frac{wr_1}{v}}}{r_1^{3/2}}.$$

2. The method according to claim 1, wherein, not only the speaker subarrays are used to form the virtual sound source behind the screen, but also form a front focused sound source so as to allow the virtual sound source with various depths, wherein:

'$y_3$' denotes a normal distance between the speaker array and the virtual sound source in front of the speaker array, '$y_4$' denotes another normal distance between the speaker array and the audience in front of the speaker array, '$r_2$' denotes a straight-line distance between the virtual sound source and the transducer, '$Q_1(a)$' denotes driving signals of the first transducer group, '$Q_2(a)$' denotes driving signals of the second transducer group, and '$Q_3(a)$' denotes driving signals of the third transducer group; wherein, 'a' denotes the position of the transducer, '$L_1$' denotes a distance from the first transducer group to the second transducer group, '$L_2$' denotes a distance from the first transducer group to the third transducer group, 'j' denotes imaginary number, 'w' denotes angular frequency, 'e' denotes natural logarithm, and 'v' denotes sound speed; wherein, $y_4>y_3$ and conjugate functions of '$Q_1(a)$', '$Q_2(a)$' and '$Q_3(a)$' respectively are:

$$Q_1^*(a) = S_1(w)\sqrt{\frac{jwy_4}{2\pi v(y_3+y_4)}}\cdot\frac{y_3 e^{-j\frac{wr_1}{v}}}{r_2^{3/2}};$$

$$Q_2^*(a) = S_2(w)\sqrt{\frac{jw(y_4-L_1)}{2\pi v(y_3+y_4-2L_1)}}\cdot\frac{(y_3-L_1)e^{-j\frac{wr_1}{v}}}{r_2^{3/2}};$$

$$Q_3^*(a) = S_3(w)\sqrt{\frac{jw(y_4-L_2)}{2\pi v(y_3+y_4-2L_2)}}\cdot\frac{(y_3-L_2)e^{-j\frac{wr_1}{v}}}{r_2^{3/2}};$$

wherein, 'Q*(a)' represents the conjugate of 'Q(a)'.

3. The method according to claim 2, wherein the speaker array embodies a single virtual sound source and a reflected sound of the virtual sound source at a same time when another virtual sound source having the same acoustic signals with the virtual sound source at different positions is formed; in which, an amplitude of the acoustic signals is attenuated by β times and relationship between driving signals J(a) of the transducer and the virtual sound source is expressed by:

$$J_1(a) = \frac{1}{\beta(w)}S_1(w)\sqrt{\frac{jwy_2}{2\pi v(y_1+y_2)}}\cdot\frac{y_1 e^{-j\frac{wr_1}{v}}}{r_1^{3/2}};$$

$$J_2(a) = \frac{1}{\beta(w)}S_2(w)\sqrt{\frac{jw(y_2-L_1)}{2\pi v(y_1+y_2)}}\cdot\frac{(y_1+L_1)e^{-j\frac{wr_1}{v}}}{r_1^{3/2}};$$

$$J_3(a) = \frac{1}{\beta(w)}S_3(w)\sqrt{\frac{jw(y_2-L_2)}{2\pi v(y_1+y_2)}}\cdot\frac{(y_1+L_2)e^{-j\frac{wr_1}{v}}}{r_1^{3/2}};$$

wherein, β(w) is a function relating to frequencies of reflected sounds and reflection coefficients; wherein the method increases the audience's sense of space and distance through the reflected sounds being formed at different positions, and further a sense of reverberation from the virtual sound sources through the attenuated reflected sounds at different positions that form the changeable reverberations.

* * * * *